US009208967B2

(12) United States Patent
Kato et al.

(10) Patent No.: US 9,208,967 B2
(45) Date of Patent: Dec. 8, 2015

(54) SWITCHING DEVICE

(71) Applicant: OMRON Corporation, Kyoto-shi, Kyoto (JP)

(72) Inventors: Tomonobu Kato, Shiga (JP); Takeshi Miyasaka, Shiga (JP); Toshinori Yamasue, Shiga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/168,619

(22) Filed: Jan. 30, 2014

(65) Prior Publication Data

US 2014/0225687 A1 Aug. 14, 2014

(30) Foreign Application Priority Data

Feb. 13, 2013 (JP) ..... 2013-025976

(51) Int. Cl.

| | |
|---|---|
| ***H01H 7/16*** | (2006.01) |
| ***H01H 9/44*** | (2006.01) |
| *H01H 1/24* | (2006.01) |
| *H01H 9/30* | (2006.01) |

(52) U.S. Cl.

CPC ..... *H01H 9/443* (2013.01); *H01H 1/24* (2013.01); *H01H 2009/305* (2013.01)

(58) Field of Classification Search

CPC ..... H01H 9/36; H01H 9/00; H01H 50/00; H01H 51/08; H01F 7/00; H01F 7/16

USPC ..... 335/201

See application file for complete search history.

(56) References Cited

U.S. PATENT DOCUMENTS

| | | | | |
|---|---|---|---|---|
| 2,540,185 | A * | 2/1951 | Brown | 335/156 |
| 4,378,722 | A * | 4/1983 | Isakson | 84/726 |
| 4,878,412 | A * | 11/1989 | Resnick | 84/726 |
| 5,015,978 | A * | 5/1991 | Yokoo et al. | 335/78 |
| 5,734,308 | A * | 3/1998 | Dittmann et al. | 335/78 |
| 6,076,550 | A * | 6/2000 | Hiraishi et al. | 137/550 |
| 6,150,808 | A * | 11/2000 | Yagyu et al. | 324/207.21 |
| 2001/0006331 | A1 * | 7/2001 | Shibata et al. | 318/560 |
| 2001/0055002 | A1 * | 12/2001 | Endo | 345/156 |
| 2002/0081220 | A1 * | 6/2002 | Ota et al. | 417/410.5 |
| 2003/0002208 | A1 * | 1/2003 | Shibata et al. | 360/99.04 |
| 2003/0102731 | A1 * | 6/2003 | Shibata et al. | 310/67 R |
| 2003/0174438 | A1 * | 9/2003 | Komatsu et al. | 360/99.01 |

(Continued)

FOREIGN PATENT DOCUMENTS

| | | | |
|---|---|---|---|
| CN | 1153229 | C | 6/2004 |
| CN | 102592864 | A | 7/2012 |

(Continued)

OTHER PUBLICATIONS

Examination Report issued in corresponding Chinese Application No. 201410042899.3, mailed on Jul. 29, 2015 (5 pages).

*Primary Examiner* — Shawki S Ismail
*Assistant Examiner* — Lisa Homza
(74) *Attorney, Agent, or Firm* — Osha Liang LLP

(57) ABSTRACT

A switching device that causes a force to act on an arc to diffuse the arc, has a magnet that generates a magnetic field in a direction orthogonal to a direction of the arc, the arc being generated at moment at which a movable member is brought into contact with or separated from a contact of a fixed member to switch between electric conduction and electric cutoff. The magnet is a plastic magnet in which metal is exposed to a surface of the magnet.

8 Claims, 7 Drawing Sheets

(56) References Cited

U.S. PATENT DOCUMENTS

| | | | | |
|---|---|---|---|---|
| 2004/0245957 | A1* | 12/2004 | Shibata et al. | 318/560 |
| 2005/0156469 | A1* | 7/2005 | Nishida et al. | 310/40 MM |
| 2005/0286165 | A1* | 12/2005 | Komatsu et al. | 360/99.04 |
| 2006/0284710 | A1* | 12/2006 | Takatsuka et al. | 335/205 |
| 2007/0257753 | A1* | 11/2007 | Tomaki et al. | 335/215 |
| 2012/0181953 | A1* | 7/2012 | Hsu et al. | 318/139 |
| 2013/0222088 | A1* | 8/2013 | Kashiwagi et al. | 335/205 |
| 2014/0251780 | A1* | 9/2014 | Ishikawa et al. | 200/561 |

FOREIGN PATENT DOCUMENTS

| | | | |
|---|---|---|---|
| JP | S57-84520 | A | 5/1982 |
| JP | 2004-178953 | A | 6/2004 |

* cited by examiner

| Sample | Composition amount (wt%) |
|---|---|
| No.1 | 1.98 |
| No.2 | 1.93 |
| No.3 | 1.93 |
| No.4 | 1.97 |
| No.5 | 1.96 |
| No.6 | 1.95 |
| No.7 | 1.92 |
| No.8 | 2.01 |
| No.9 | 1.97 |
| ave. | 1.96 |
| 3σ | 0.09 |
| ave.+3σ | 2.04 |
| ave.−3σ | 1.87 |

| Sample | Composition amount (wt%) |
|---|---|
| No.1 | 10.05 |
| No.2 | 10.01 |
| No.3 | 10.01 |
| No.4 | 10.24 |
| No.5 | 10.11 |
| No.6 | 10.11 |
| ave. | 10.09 |
| 3σ | 0.27 |
| ave.+3σ | 10.35 |
| ave.−3σ | 9.82 |

FIG. 8
| | Before test | After test |
|---|---|---|
| Dimensions | 11.09 × 8.98 × 4.57 | 11.08 × 8.98 × 4.57 |
| Appearance | NO lifting/<br>no corrosion | NO lifting/<br>no corrosion |
| Magnetic flux density | 22.8 mT (NO cutoff)<br>14.2 mT (NC cutoff) | 22.7 mT (NO cutoff)<br>14.1 mT (NC cutoff) |
FIG. 9A
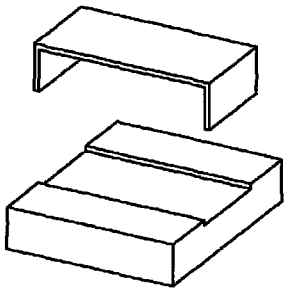
FIG. 9B
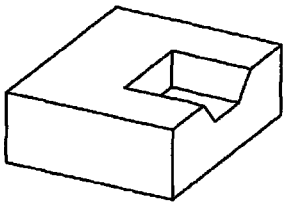

SWITCHING DEVICE

BACKGROUND OF THE INVENTION

1. Technical Field

The present invention relates to a switching device that switches between electric conduction and electric cutoff by bringing or separating a movable member into contact with or from a contact of a fixed member.

2. Related Art

Conventionally a switch, which controls the electric conduction and the electric cutoff by bringing or separating the movable member into contact with or from the fixed member, is in widespread use. In the switch, an arc (a discharge phenomenon in which a current moves in a gap between a surface of the movable contact and a surface of the fixed contact) is generated mainly at moment at which the movable contact is separated from the fixed contact. Conventionally, a lifetime of the switch is shortened because a quality of material of the surface degrades by the generation of the arc.

Thus, there has been proposed a technology, in which a magnetic field is generated in a direction orthogonal to a current moving direction and a force is caused to act on electrons constituting the arc to encourage diffusion of the arc. For example, Japanese Unexamined Patent Publication No. 57-84520 discloses the switch in which the magnet generating the magnetic field at a point at which the fixed contact and the movable contact come into contact with each other is provided at a fixed position in a direction intersecting the movable contact moving direction. Japanese Unexamined Patent Publication No. 2004-178953 discloses a magnetic arc elimination type switch device including the magnet that applies the magnetic field to the arc with magnetic flux density of 85 mT or more.

In the conventional technologies disclosed in Japanese Unexamined Patent Publication No. 57-84520 and 2004-178953, it is assumed that the magnetic field is generated using the metallic magnet. On the other hand, it is conceivable that a plastic magnet is used instead of the metallic magnet for the purpose of cost reduction or weight reduction of the switch. However, the use of the plastic magnet may result in the surface of the plastic magnet being melted by the heat of the arc. This is attributed to the fact that a temperature of the heat generated by the arc is higher than a melting point of plastic while being lower than a melting point of metal.

Degradation of switch performance due to the melt of the surface of the plastic magnet will be described with reference to FIG. 10. FIG. 10 is a graph comparing time (cutoff time) necessary for the switch including the metallic magnet to cut off the current and time necessary for the switch including the plastic magnet to cut off the current before and after a test to switch the switch from a conduction state to a cutoff state one hundred thousand times when a time constant is set to 7 ms under an inductive load of 125 volts and 6 amperes.

As illustrated in FIG. 10, because the surface of the metallic magnet is not melted, the cutoff time does not change before and after the test. On the other hand, since the surface of the conventional plastic magnet is melted, an average value of the cutoff time increases prominently after the test, and a variance of the cutoff time also increases significantly. This is because a magnetic force is weakened by the melt of the surface to degrade the performance diffusing the arc. Therefore, the switch performance also degrades.

In the case where the magnet is disposed while brought close to the position at which the arc is generated for the purpose of downsizing of the switch, or in the case where the switch is used to cut off the current of a higher load, melting may be worse, because the magnet is strongly influenced by the heat of the arc. In view of the above, the use of the metallic magnet as the magnet diffusing the arc exists as a natural assumption commonly recognized by those skilled in the art. Therefore, those skilled in the art hardly consider a configuration in which the plastic magnet is used.

SUMMARY

One or more embodiments of the present invention provides a switching device having a structure in which the plastic magnet is protected by exposing the metallic material from the plastic magnet.

In accordance with one or more embodiments of the present invention, a switching device that causes a force to act on an arc to diffuse the arc, the switching device includes a magnet configured to generate a magnetic field in a direction orthogonal to a direction of the arc, the arc being generated at moment at which a movable member is brought into contact with or separated from a contact of a fixed member to switch between electric conduction and electric cutoff. In the switching device, the magnet is a plastic magnet in which metal is exposed to a surface of the magnet.

As described above, the plastic magnet has not been used as the magnet that diffuses the arc. The use of the metallic magnet exists as a natural assumption due to the surface of the plastic magnet being melted by the heat of the arc.

In a switching device according to one or more embodiments of the present invention, the plastic magnet is used as the magnet. However, the metal is exposed to the surface of the plastic magnet. Therefore, in the switching device, the surface of the magnet is not melted by the heat of the arc because the plastic magnet is protected.

In a switching device according to one or more embodiments of the present invention, the magnet is the plastic magnet, in which a composition ratio of the plastic resin falls within a predetermined range to expose the metal to the surface of the magnet.

That is, the switching device causes the metallic character (high melting point) that is originally possessed by the magnet to emerge to the surface of the magnet using the plastic magnet in which the composition amount of the resin is adjusted to the predetermined amount. At this point, a neodymium bond magnet (a neodymium plastic magnet) in which epoxy resin (plastic resin) is mixed or a metallic-powder (for example, samarium iron nitrogen) ferrite magnet in which nylon resin (plastic resin such as nylon 12) is mixed can be used as the plastic magnet.

Therefore, in the switching device, the surface of the magnet is not melted by the heat of the arc because the plastic magnet is protected.

In a switching device according to one or more embodiments of the present invention, the magnet is the plastic magnet, in which the ratio is set to 5% or less to expose the metal to the surface of the magnet.

According to one or more embodiments of the present invention, from the viewpoint of production cost and heat durability, it is experimentally found that a ratio of the plastic resin mixed in the magnet is less than or equal to 5%. Accordingly, in the switching device, the surface of the magnet is not melted by the heat of the arc because the plastic magnet is protected.

In a switching device according to one or more embodiments of the present invention, the magnet is the plastic magnet, in which a heat shield plate is formed by predetermined metal to expose the metal to the surface of the magnet.

Therefore, in the switching device, the surface of the magnet is not melted by the heat of the arc because the magnet is protected with the heat shield plate.

In a switching device according to one or more embodiments of the present invention, the magnet is the plastic magnet, in which insert molding of the metal is performed to the magnet to form the heat shield plate made of the metal and therefore the metal is exposed to the surface of the magnet.

Therefore, in the switching device, the surface of the magnet is not melted by the heat of the arc because the magnet is protected with the heat shield plate while being in close contact with the metal.

In a switching device according to one or more embodiments of the present invention, a burr is provided in an inner wall of the heat shield plate, a dimple corresponding to the burr is formed in the surface of the magnet, and therefore the magnet and the heat shield plate are integrated with each other.

Therefore, adhesion between the magnet and the heat shield plate is improved, so that productivity of the switching device can be improved.

In a switching device, according to one or more embodiments of the present invention, a punching hole is made in an inner wall of the heat shield plate, a projection corresponding to the punching hole is formed on the surface of the magnet, and therefore the magnet and the heat shield plate are integrated with each other.

Therefore, the adhesion between the magnet and the heat shield plate is improved, so that the productivity of the switching device can be improved.

In a switching device according to one or more embodiments of the present invention, the magnet is the plastic magnet in which the metal is exposed to the surface of the magnet. Accordingly, in the switching device according to one or more embodiments of the present invention, advantageously the surface of the magnet can hardly be melted even by the heat of the arc.

BRIEF DESCRIPTION OF THE DRAWINGS

FIG. 3A is a sectional view taken on a line A-A in FIG. 2, and FIG. 3B is a sectional view taken on a line B-B in FIG. 2;

FIG. 4A is an enlarged view illustrating an inside of a square drawn by a dotted line in FIG. 3A, and FIG. 4B is an enlarged view illustrating the inside of the square drawn by the dotted line in FIG. 3B;

FIG. 7A illustrates the structure of the heat shield plate when the magnet and the heat shield plate are integrated by burring, FIG. 7B illustrates the structure of the heat shield plate when the magnet and the heat shield plate are integrated by punching.

FIG. 8 is a table illustrating changes in dimensions, appearance, and magnetic flux density of the magnet before and after a test in which the magnet is left for 96 hours under an environment of 80° C.;

FIG. 9A illustrates the magnet in which a general plastic magnet and a component formed by pressing predetermined metal are assembled to improve a heat resisting property, FIG. 9B illustrates the magnet in which a surface of a portion subject to an arc is cut out to avoid the arc.

DETAILED DESCRIPTION

Embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

First Embodiment

Figure 1:
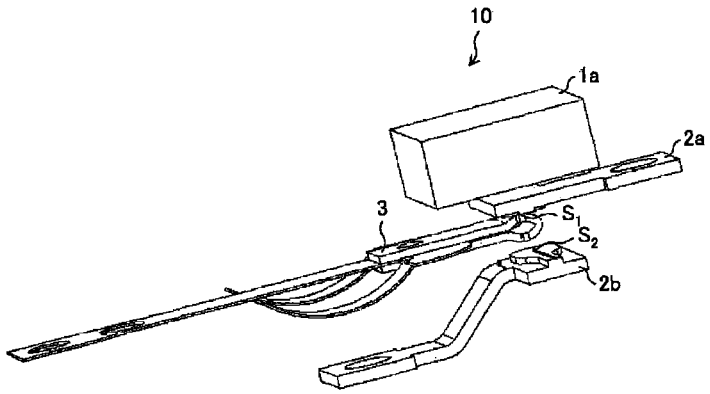
FIG. 1 is a block diagram illustrating a main-part configuration of a switch according to one or more embodiments of the present invention.

A first embodiment of the present invention will be described with reference to FIGS. 1 to 6. A configuration of a switch 10 will be described with reference to FIG. 1. FIG. 1 is a schematic diagram illustrating a main-part configuration of the switch 10. A relationship between the whole switch 10 and a main part in FIG. 1 is described later with reference to FIGS. 2 to 4B.

The switch (switching device) 10 switches between electric conduction and electric cutoff by bringing or separating a movable member 3 into contact with or from a contact $S_1$ of a fixed member 2*a* or a contact $S_2$ of a fixed member 2*b*. The switch 10 includes a magnet 1*a*, the fixed member 2*a*, the fixed member 2*b*, and the movable member 3.

The movable member 3 is a thin plate-like member made of conductive metal. One of end portions (hereinafter referred to as a "movable end portion") of the movable member moves between the contact $S_1$ and the contact $S_2$ so as to be brought into contact with or separated from the fixed member 2*a* or the fixed member 2*b* at the contact $S_1$ or the contact $S_2$ with the other fixed end portion (hereinafter referred to as a "fixed end portion") as a support point. When the movable end portion is in contact with the fixed member 2*a* at the contact $S_1$, a current flows from the fixed end portion of the movable member 3 toward the fixed member 2*a*. Accordingly, the arc is generated from the contact $S_2$ toward the contact $S_1$ at the moment at which the movable end portion is separated from the contact $S_1$ to move toward the contact $S_2$, and the arc is generated from the contact $S_1$ toward the contact $S_2$ at the moment at which the movable end portion is separated from the contact $S_2$ to move toward the contact $S_1$.

The fixed member 2*a* and the fixed member 2*b* are made of conductive metal. The fixed member 2*a* has a thin plate shape, and is fixed to an outer frame 4 (not illustrated in FIG. 1, see FIGS. 3A and 3B) of the switch 10. The fixed member 2*b* has a shape in which a central portion of the thin plate having the same shape as the fixed member 2*a* is bent at an angle of about 45 degrees with respect to a horizontal direction such that the end portion on a side including the contact $S_2$ is raised. The fixed member 2*b* is fixed to the outer frame 4 such that one of the end portions (the end portion on the side including the contact $S_1$) of the fixed member 2*a* and one of the end portions (the end portion on the side including the contact $S_2$) of the fixed member 2*b* are faced each other across the movable end portion of the movable member 3.

The magnet 1*a* is a plastic magnet, which is fixed to an upper portion (an extending direction of the direction from the contact $S_2$ toward the contact $S_1$) of the fixed member 2*a* such that a magnetic field of the magnet emerges orthogonal to the direction (hereinafter referred to as an "arc generation direction") in which the arc is generated. Therefore, the arc does not continue, but diffuses in air, because the arc (particularly, electrons constituting the arc) are attracted in the direction (the direction orthogonal to both the arc generation direction and the direction in which the magnetic field is generated, hereinafter referred to as an "arc elimination direction") of force defined by Fleming's left-hand rule. It is to be noted that a position of the magnet 1*a*, the direction of a magnetic pole, and the shape of the magnet 1*a* be illustrated only by way of example. The position, the direction of the magnetic pole, and the shape may arbitrarily be selected as long as the magnetic field of the magnet emerges orthogonal to the arc generation direction.

A surface of the magnet 1*a* is influenced by heat of the arc although the magnet 1*a* does not exist in the arc elimination direction. This is because the arc has a character that spreads radially so as to draw an arc that is strung with the arc generation direction as a string. Accordingly, in the conventional technology, the surface of the plastic magnet is melted only by substituting the plastic magnet for the metallic magnet.

Therefore, a metallic component of the plastic magnet is exposed to the surface in the magnet 1*a* included in the switch 10. Specifically, the metallic character (a high melting point) that is originally possessed by the magnet is caused to emerge on the surface of the magnet using the plastic magnet, such as a neodymium bond magnet (a neodymium plastic magnet, hereinafter referred to as a "neodymium bond") in which about 3% of epoxy resin (plastic resin) is mixed and a metallic-powder (for example, samarium iron nitrogen or the like) ferrite magnet (hereinafter referred to as "samarium iron ferrite") in which about 3% of nylon resin (plastic resin such as nylon 12) is mixed, in which a composition amount of resin is adjusted to a predetermined optimum amount (for example, about 3%). Therefore, the melting point of the magnet 1*a* is raised, and the surface of the magnet can hardly be melted even by the heat of the arc.

Figure 2:
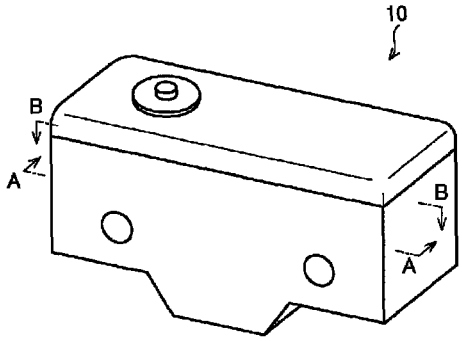
FIG. 2 is a schematic diagram illustrating an appearance of the switch.

An appearance of the switch 10 will be described with reference to FIG. 2. FIG. 2 is a schematic diagram illustrating the appearance of the switch 10. As illustrated in FIG. 2, the switch 10 has a substantially rectangular parallelepiped shape. Dimensions of the switch 10 can properly be changed depending on the intended use.

Figure 3A:
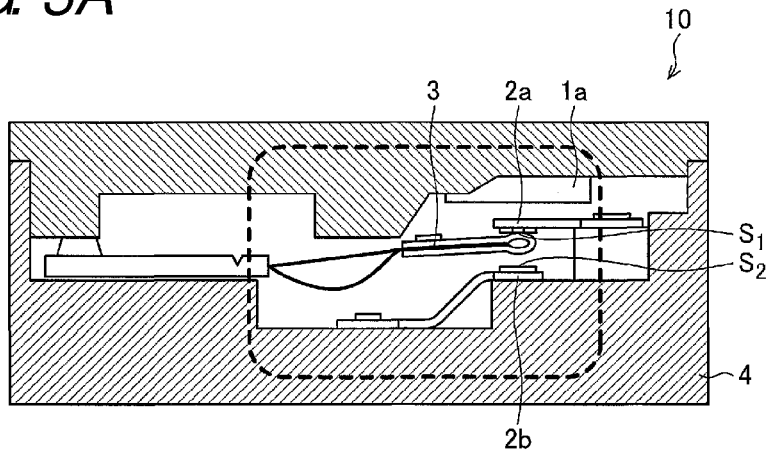
FIGS. 3A-3B are sectional views illustrating an internal structure of the switch.
Figure 3B:
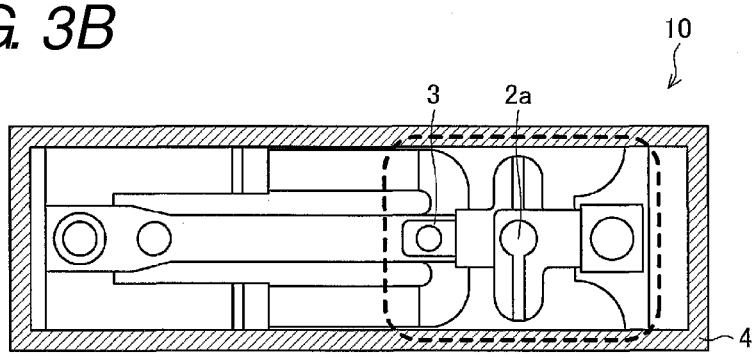

An internal structure of the switch 10 will be described with reference to FIGS. 3A-3B. FIGS. 3A-3B are sectional views illustrating the internal structure of the switch 10, FIG. 3A is a sectional view taken on a line A-A in FIG. 2, and FIG. 3B is a sectional view taken on a line B-B in FIG. 2. As illustrated in FIGS. 3A and 3B, the main-part configuration in FIG. 1 is disposed in the outer frame 4.

Figure 4A:
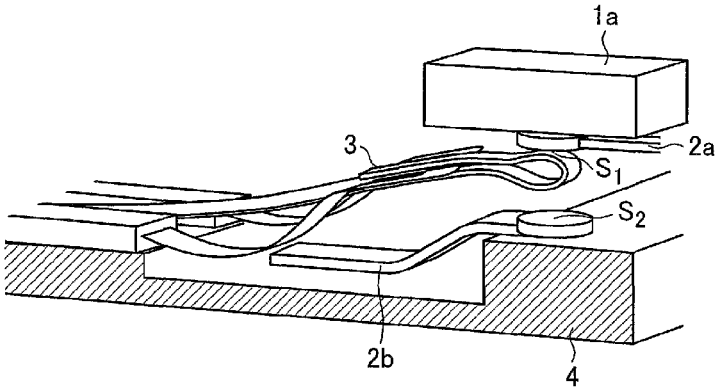
FIGS. 4A-4B are enlarged sectional views illustrating the internal structure of the switch.
Figure 4B:
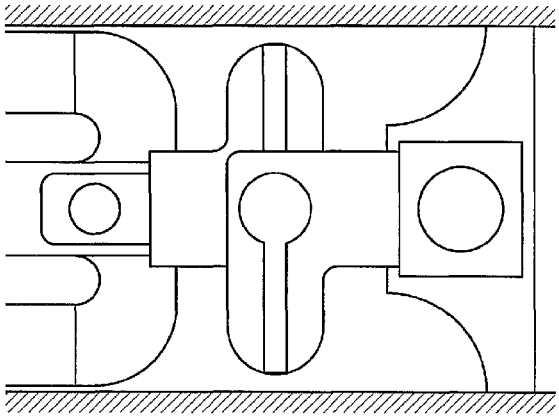

The internal structure of the switch 10 will further be described with reference to FIGS. 4A-4B. FIGS. 4A-4B are enlarged sectional views illustrating the internal structure of the switch 10, FIG. 4A is an enlarged view illustrating an inside of a square drawn by a dotted line in FIG. 3A, and FIG. 4B is an enlarged view illustrating the inside of the square drawn by the dotted line in FIG. 3B. As illustrated in FIGS. 4A and 4B, a front end of the movable end portion is brought into contact with the fixed member 2*a* at the contact $S_1$, and the current thereby flows. On the other hand, the front end of the movable end portion is brought into contact with the fixed member 2*b* at the contact $S_2$, and the current is thereby cut off. It is to be noted that the relationship between the electric conduction and the electric cutoff corresponding to the contact of the front end of the movable end portion with the fixed member 2*a* or the fixed member 2*b* may be reversed.

Figures 5A, 5B, 6:
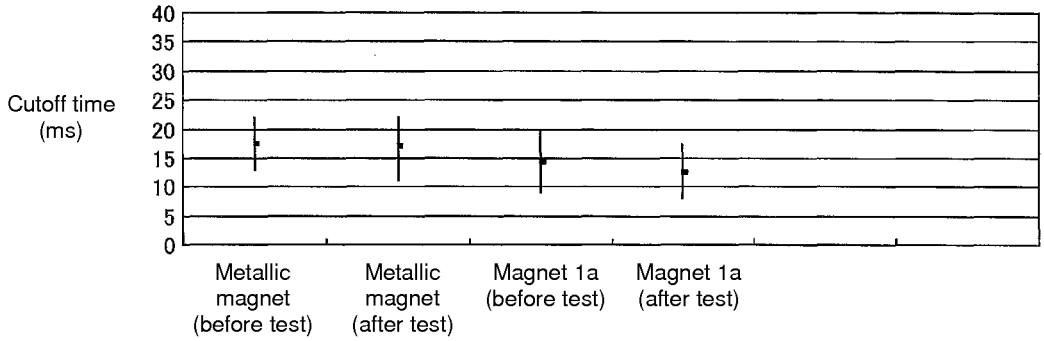
FIG. 5A is a table illustrating a composition amount in each sample of a neodymium bond in which a composition amount of an epoxy resin is set to 2% (average composition amount of nine samples is 1.96%, and standard deviation of composition amount is 0.03%)
FIG. 5B is a table illustrating the composition amount in each sample of samarium iron ferrite in which the composition amount of a nylon resin is set to 10% (average composition amount of six samples is 10.09%, and standard deviation of composition amount is 0.07%)
FIG. 6 is a graph comparing time necessary for a switch including a metallic magnet to cut off a current and time necessary for a switch including a plastic magnet, in which the composition amount of the resin is adjusted to a predetermined optimum amount, to cut off a current before and after a test to switch the switch from a conduction state to a cutoff state one hundred thousand times when a time constant is set to 7 ms under an inductive load of 125 volts and 6 amperes.

The optimum composition amount of the plastic resin will be described with reference to FIGS. 5A-5B. FIG. 5A is a table illustrating the composition amount in each sample of the neodymium bond in which the composition amount of the epoxy resin is set to 2% (an average composition amount of nine samples is 1.96%, and a standard deviation of the composition amount is 0.03%), and FIG. 5B is a table illustrating the composition amount in each sample of the samarium iron ferrite in which the composition amount of the nylon resin is set to 10% (the average composition amount of six samples is 10.09%, and the standard deviation of the composition amount is 0.07%);

As illustrated in FIG. 5A, in the case where the plastic magnet in which the composition amount of the resin is adjusted to 2% is used as the magnet 1*a*, the surface of the magnet is not melted by the heat of the arc (described later with reference to FIG. 6). On the other hand, as illustrated in FIG. 5B, in the case where the plastic magnet in which the composition amount of the resin is adjusted to 10% is used as the magnet 1*a*, the surface of the magnet is melted by the heat of the arc. Accordingly, the surface of the magnet is not melted by the heat of the arc when an average value of the composition amounts of the plural samples ranges from 2% to 9% (according to one or more embodiments of the present invention, the average value is less than or equal to 5% from the viewpoint of production cost and durability against the heat of the arc).

Heat durability of the switch 10 will be described with reference to FIG. 6. FIG. 6 is a graph comparing time (cutoff time) necessary for the switch including the metallic magnet to cut off the current and time necessary for the switch 10 including the magnet 1*a* to cut off the current before and after a test to switch the switch from a conduction state to a cutoff state one hundred thousand times when a time constant is set to 7 ms under an inductive load of 125 volts and 6 amperes.

As illustrated in FIG. 6, in the magnet 1*a* (the neodymium bond in which the composition amount of the epoxy resin is set to 2%) included in the switch 10, the cutoff time does not change before and after the test. That is, the magnet 1*a* in which the metallic character originally possessed by the magnet is caused to emerge onto the surface of the magnet withstands the heat of the arc using the plastic magnet in which the composition amount of the resin is adjusted to the predetermined optimum amount. Accordingly, the performance of the switch 10 can be maintained because the power to diffuse the arc does not degrade.

Second Embodiment

A second embodiment of the present invention will be described with reference to FIGS. 7A to 9B.

Similarly to the switch 10, a switch (switching device) 11 switches between the electric conduction and the electric cutoff by bringing or separating the movable member 3 into contact with or from the contact $S_1$ of the fixed member 2*a* or the contact $S_2$ of the fixed member 2*b*. The switch 11 includes a magnet 1*b*, the fixed member 2*a*, the fixed member 2*b*, and the movable member 3. That is, in the second embodiment, the switch 11 includes the magnet 1*b* instead of the magnet 1*a* of the first embodiment. The same component as the component included in the switch 10 is designated by the same numeral, and the overlapping description is neglected. Only the magnet 1*b* will be described below in detail.

Similarly to the magnet 1*a*, the magnet 1*b* is a plastic magnet, which is fixed to the upper portion (the extending direction of the direction from the contact $S_2$ toward the contact $S_1$) of the fixed member 2*a* such that the magnetic field of the magnet emerges orthogonal to the arc generation direction. However, the magnet 1*b* differs from the magnet 1*a* in that the composition amount of the resin is not necessarily adjusted to the predetermined optimum amount. The magnet, in which insert molding of the general plastic magnet is performed to predetermined metal such as brass to expose the metallic portion to the surface of the plastic magnet, is used as the magnet 1*b*. Therefore, because the magnet is covered with a heat shield plate of the metal, the surface of the magnet is not melted by the heat of the arc.

It is to be noted that the productivity of the method for performing the insert molding of the magnet 1*b* and the heat shield plate be higher than that of the method for assembling the magnet 1*b* and heat shield plate, which are individually produced. This is because man-hour necessary for the assembly and the number of production facilities can be reduced.

Figure 7A:
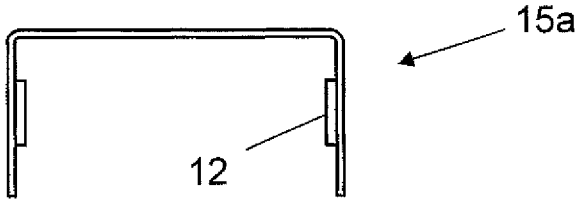
FIGS. 7A-7B are schematic diagrams illustrating an example of a structure in which the magnet and a heat shield plate are integrated with each other.
Figure 7B:
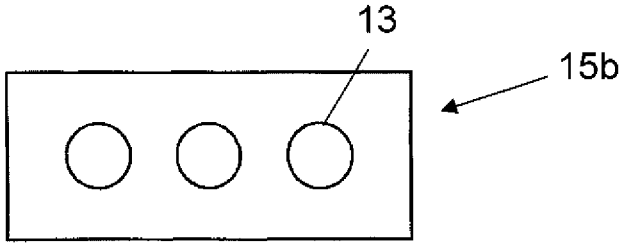
Figure 7C:
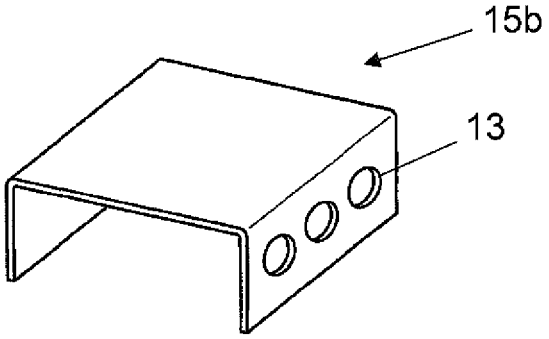
FIG. 7C illustrates the appearance of the heat shield plate when the punching in FIG. 7B is performed.

A structure in which the magnet 1*b* and the heat shield plate are integrated with each other will be described with reference to FIGS. 7A-7C. FIGS. 7A-7C are schematic diagrams illustrating an example of the structure in which the magnet 1*b* and the heat shield plate are integrated with each other, FIG. 7A illustrates the structure of the heat shield plate when the magnet 1*b* and the heat shield plate are integrated by burring, and FIG. 7B illustrates the structure of the heat shield plate when the magnet 1*b* and the heat shield plate are integrated by punching. FIG. 7C illustrates the appearance of the heat shield plate when the punching in FIG. 7B is performed.

Figure 7D:
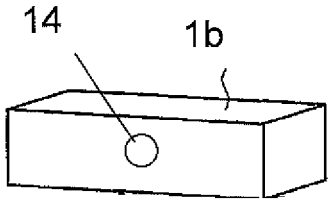
FIG. 7D illustrates the magnet having a dimple.
Figure 7E:
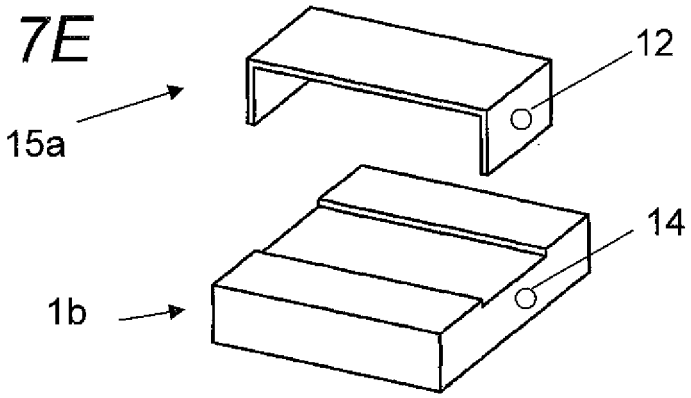
FIG. 7E shows the heat shield plate being integrated with the magnet.
Figure 10:
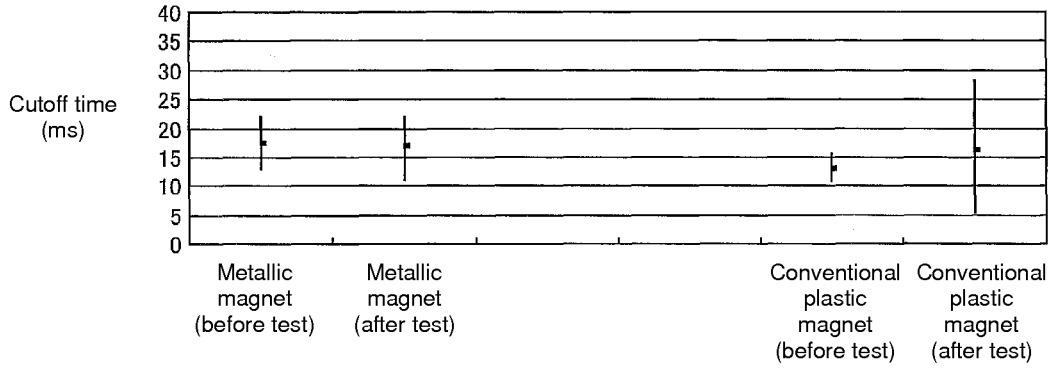
FIG. 10 is a graph comparing time (cutoff time) necessary for the conventional switch including the metallic magnet to cut off the current and time necessary for the conventional switch including the plastic magnet to cut off the current before and after the test to switch the conventional switch one hundred thousand times.

As illustrated in FIG. 7A, a projected burr 12 is provided in an inner wall of the heat shield plate 15*a*. As illustrated in FIG. 7D, a dimple 14 corresponding to the burr 12 is formed in the surface of the magnet 1*b*, and, as shown in FIG. 7E, the magnet 1*b* and the heat shield plate 15*a* are integrated with each other, thereby enhancing adhesion between the magnet 1*b* and the heat shield plate 15.

As illustrated in FIG. 7B, a punched hole 13 is made in the inner wall of the heat shield plate 15*b*, a projection corresponding to the punched hole 13 is formed on the surface of the magnet 1*b*, and the magnet 1*b* and the heat shield plate 15*b* are integrated with each other, thereby enhancing the adhesion between the magnet 1*b* and the heat shield plate 15*b*. The heat shield plate 15*b* in which the punched hole 13 is made exerts the appearance in FIG. 7C.

The heat durability of the switch 11 will be described with reference to FIG. 8. FIG. 8 is a table illustrating changes in dimensions, appearance, and magnetic flux density of the magnet 1*b* before and after a test in which the magnet 1*b* is left for 96 hours under an environment of 80° C.

As illustrated in FIG. 8, evaluation items (the dimensions, the appearance, and the magnetic flux density) of the magnet 1*b* exert little change before and after the test. That is, the magnet 1*b*, in which the insert molding of the general plastic magnet is performed to the predetermined metal to expose the metallic portion to the surface of the plastic magnet, withstands the heat of the arc. Accordingly, the performance of the switch 11 can be maintained because the power to diffuse the arc does not degrade.

OTHER MODIFICATIONS

In the second embodiment, the insert molding of the general plastic magnet is performed to the predetermined metal (for example, brass). However, the method for protecting the surface of the plastic magnet with the metal to expose the metallic portion to the surface of the plastic magnet is not limited to the method of the second embodiment.

Another method for exposing the metallic portion to the surface of the magnet will be described with reference to FIGS. 9A-9B. FIG. 9A illustrates the magnet 1*b* in which the general plastic magnet and a component formed by pressing predetermined metal are assembled to improve a heat resisting property. FIG. 9B illustrates the magnet 1*b* in which the surface of a portion subject to the arc is cut out to avoid the arc.

As illustrated in FIG. 9A, the magnet, in which the metallic portion is exposed to the surface of the general plastic magnet by fitting the component formed by pressing the predetermined metal (for example, brass) in the general plastic magnet (to which the working corresponding to the shape of the component is performed), may be used as the magnet 1*b*. Alternatively, the magnet, in which the metallic portion is exposed to the surface of the general plastic magnet by performing metallic plating (for example, nickel plating) to the plastic magnet, may be used as the magnet 1*b* (not illustrated).

As illustrated in FIG. 9B, the surface of the portion subject to the arc is cut out to avoid the arc, which allows the heat-resisting property of the magnet to be improved.

The present invention is not limited to the first embodiment or the second embodiment, but various changes can be made without departing from the scope of the present invention. An embodiment obtained by a proper combination of technical means disclosed in the above embodiments is also included in the technical scope of the present invention. Additionally, a new technical feature can be made by combining the technical means disclosed in the above embodiments.

For example, the metallic portion may be exposed to the surface of the magnet by performing the insert molding of the predetermined metal to the plastic magnet in which the composition amount of the resin is adjusted to the predetermined optimum amount (a combination example of the first embodiment and the second embodiment). Therefore, the heat resisting property of the magnet can further be improved.

One or more embodiments of the present invention can widely be applied to the switching device that switches between the electric conduction and the electric cutoff by bringing or separating the movable member into contact with or from the contact of the fixed member.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A switching device that causes a force to act on an arc to diffuse the arc, comprising:

a magnet that generates a magnetic field in a direction orthogonal to a direction of the arc, the arc being generated at moment at which a movable member is brought into contact with or separated from a contact of a fixed member to switch between electric conduction and electric cutoff, wherein the magnet is a plastic magnet in which metal is exposed to a surface of the magnet, and wherein the magnet is the plastic magnet, in which a heat shield plate is formed by predetermined metal to expose the metal to the surface of the magnet.

2. The switching device according to claim 1, wherein the magnet is the plastic magnet, in which a composition ratio of the plastic resin falls within a predetermined range to expose the metal to the surface of the magnet.

3. The switching device according to claim 2, wherein the magnet is the plastic magnet, in which the ratio is set to 5% or less to expose the metal to the surface of the magnet.

4. The switching device according to claim 1, wherein the magnet is the plastic magnet, in which insert molding of the metal is performed to the magnet to form the heat shield plate made of the metal and therefore the metal is exposed to the surface of the magnet.

5. The switching device according to claim 4, wherein a burr is provided in an inner wall of the heat shield plate, wherein a dimple corresponding to the burr is formed in the surface of the magnet, and wherein the magnet and the heat shield plate are integrated with each other.

6. The switching device according to claim 4, wherein a punching hole is made in an inner wall of the heat shield plate, wherein a projection corresponding to the punching hole is formed in the surface of the magnet, and wherein the magnet and the heat shield plate are integrated with each other.

7. The switching device according to claim 1, wherein a burr is provided in an inner wall of the heat shield plate, wherein a dimple corresponding to the burr is formed in the surface of the magnet, and wherein the magnet and the heat shield plate are integrated with each other.

8. The switching device according to claim 1, wherein a punching hole is made in an inner wall of the heat shield plate, wherein a projection corresponding to the punching hole is formed in the surface of the magnet, and wherein the magnet and the heat shield plate are integrated with each other.

* * * * *